US007481265B2

(12) United States Patent
Youssef

(10) Patent No.: US 7,481,265 B2
(45) Date of Patent: Jan. 27, 2009

(54) AIR COOLER FOR POWER PLANTS AND USE OF SUCH AN AIR COOLER

(75) Inventor: Mustafa Youssef, Zurich (CH)

(73) Assignee: Alstom Technology Ltd, Baden (CH)

( * ) Notice: Subject to any disclaimer, the term of this patent is extended or adjusted under 35 U.S.C. 154(b) by 673 days.

(21) Appl. No.: 11/192,175

(22) Filed: Jul. 29, 2005

(65) Prior Publication Data

US 2006/0080964 A1 Apr. 20, 2006

Related U.S. Application Data

(63) Continuation of application No. PCT/EP2004/050046, filed on Jan. 28, 2004.

(30) Foreign Application Priority Data

Jan. 29, 2003 (DE) ..... 103 03 341

(51) Int. Cl.
*F28D 7/02* (2006.01)
*F28F 9/22* (2006.01)

(52) U.S. Cl. ..... 165/134.1; 165/160; 165/163

(58) Field of Classification Search ..... 165/134.1, 165/160, 163

See application file for complete search history.

(56) References Cited

U.S. PATENT DOCUMENTS

| | | | | | |
|---|---|---|---|---|---|
| 3,741,167 | A | * | 6/1973 | Polcer et al. | 165/134.1 |
| 4,471,836 | A | * | 9/1984 | Hokanson | 165/160 |
| 4,681,066 | A | * | 7/1987 | Widhopf | 165/160 |
| 4,687,052 | A | * | 8/1987 | Fricker | 165/163 |
| 4,694,897 | A | * | 9/1987 | Thones | 165/160 |

FOREIGN PATENT DOCUMENTS

| | | |
|---|---|---|
| DE | 41 42 375 | 7/1993 |
| DE | 100 41 413 | 3/2001 |
| EP | 0 233 997 | 9/1987 |
| EP | 0 773 349 | 5/1997 |

* cited by examiner

*Primary Examiner*—Leonard R Leo
(74) *Attorney, Agent, or Firm*—Buchanan Ingersoll & Rooney PC

(57) ABSTRACT

An air cooler for power plants comprising a pressure vessel, in which is accommodated a coaxial arrangement containing a cylindrical central tube, a helical tube bundle surrounding the central tube and a cylindrical casing surrounding the tube bundle. The central tube extends, at one end of the coaxial arrangement, into a first space adjacent to the tube bundle and closed off outwardly by the casing. The central tube can be acted upon by air from outside the pressure vessel, via an air inlet connection piece, at the other end of the coaxial arrangement through a space adjacent to the tube bundle. Water can be fed into the tube bundle from an end of the coaxial arrangement and steam can be extracted from the tube bundle.

7 Claims, 2 Drawing Sheets

AIR COOLER FOR POWER PLANTS AND USE OF SUCH AN AIR COOLER

This disclosure is based upon German Application No. 103-03-341.6, filed Jan. 29, 2003, and International Application No. PCT/EP2004/050046, filed Jan. 28, 2004, the contents of which are incorporated herein reference.

FIELD OF THE INVENTION

The present invention relates to the field of power plant technology.

An air cooler of the type initially mentioned is known, for example, from the publication EP-A1-0 773 349 (see FIG. 5 there and the accompanying description).

BACKGROUND OF THE INVENTION

In gas turbine plants, it is customary to cool the air extracted from the compressor by means of water injection or external cooling, before it is supplied as cooling air for the cooling system of the turbine. In this case, this heat is largely lost from the system as a whole.

By contrast, as is known, in combined plants water cooling of the air is usually carried out in an air/water heat exchanger and the heat occurring as a result of the cooling of the cooling air is made re-utilizable. By means of feed pumps, the pressure on the water side is raised above the saturated steam pressure to avoid evaporation loss, and the water heated in the cooler is subsequently expanded in a low-pressure system in which it can evaporate out. In a modified solution, the heat exchanger is operated in parallel with an economizer of a heat recovery steam generator following the gas turbine group.

The air cooler is integrated as a forced-flow once-through heater into a combined power plant. Simpler regulation and higher efficiency, as compared with the abovementioned cooling of the gas turbine plants, are thereby achieved. FIG. 1, which corresponds to FIG. 1 of the publication initially mentioned, shows a combined power plant 40 with a gas and a steam turbine group. The gas turbine group consists of a compressor 1, of a following combustion chamber 2 and of a gas turbine 3 arranged downstream of the combustion chamber 2. A generator 4 ensuring current generation is coupled to the gas turbine 3. The intake air 5 sucked in by the compressor 1 is conducted, after compression, as compressed air 6 into the combustion chamber 2 and is mixed there with injected liquid and/or gaseous fuel 7. The fuel/air mixture which occurs is burnt. The hot gas 8 flowing out of the combustion chamber 2 is subsequently expanded in the gas turbine 3 so as to perform work. The exhaust gas 9 from the gas turbine 3 is thereafter utilized in a heat recovery steam generator 15 of the following steam circuit.

Since the thermal load on the combustion chamber 2 and on the gas turbine 3 is very high, a cooling of the thermally stressed assemblies, which is as effective as possible, must take place. This is carried out with the aid of an air cooler 10 which is a helical steam generator. The air cooler 10 has flowing through it a part quantity, extracted from the compressor 1, of compressed air 11 which is already to a great extent heated up. Heat exchange within the air cooler 10 takes place by means of the water part stream 12 flowing through the tubes of the helical steam generator. The compressed air 11 is therefore cooled on one side to an extent such that it is subsequently conducted as cooling air 13 to the assemblies to be cooled. The high-pressure cooler is illustrated as an example in FIG. 1. It extracts fully compressed air 11 at the outlet of the compressor 1, and its cooling air 13 is used for the cooling of assemblies in the combustion chamber 2 and in the highest pressure stage of the gas turbine 3. As an alternative to this, air of lower pressure may also be extracted from an intermediate stage of the compressor 1, said intermediate stage being used for cooling purposes in the corresponding pressure stage of the gas turbine 3.

On the other side, the water part stream 12 is heated in the cooling air cooler 10 to an extent such that the water evaporates. This steam 14 is then conducted, according to FIG. 1, into the superheater part of a heat recovery steam generator 15. It increases the fresh steam 16 by which the steam turbine 17 is acted upon and thus serves for improving the efficiency of the plant as a whole. During this normal operation of the power plant, the steam 14 generated in the cooling-air cooler 10 is thus utilized optimally in energy terms. It is likewise possible to admix the steam 14 directly with the fresh steam 16 or to conduct it to the combustion chamber 2 or to the gas turbine 3.

The exhaust gas 9 from the gas turbine 3, said exhaust gas still having a high calorific potential, flows through the heat recovery steam generator 15. By means of the heat exchange method, these convert the feed water 18 entering the heat recovery steam generator 15 to fresh steam 16 which then forms the working medium of the remaining steam circuit. The calorifically utilized exhaust gases thereafter flow as flue gas 19 to the open. The energy arising from the steam turbine 17 is converted into current via a further coupled generator 20. A multishaft arrangement is illustrated as an example in FIG. 1. Of course, single-shaft arrangements may also be selected, in which the gas turbine 3 and the steam turbine 17 run on one shaft and drive the same generator. The exhaust steam 21 from the steam turbine 17 is condensed in a water-cooled or air-cooled condenser 22. The condensate is then pumped, by means of a pump not illustrated here, into a feed water tank/deaerator, not shown in FIG. 1, which is arranged downstream of the condenser 22. The feed water 18 is subsequently pumped via a further pump into the heat recovery steam generator 15 to form a new throughflow or a part stream 12 of the water is supplied to the air cooler 10 via a regulating valve, not shown here.

Publication EP-A1-0 773 349 initially mentioned, then, proposes, in FIGS. 2 to 5 and the accompanying description parts, various types of air cooler which are particularly suitable for use in a combined power plant according to FIG. 1. In embodiments of FIGS. 2 to 4, the cooling air to be cooled is led in the vertically standing air cooler, on the inside, in a central tube from the bottom upward, past the helical tube bundle of the heat exchanger which is arranged in a pressure vessel, is deflected downward above the tube bundle and flows through the tube bundle from the top downward, at the same time discharging heat to the steam flowing in countercurrent (from the bottom upward) in the tube bundle. Cooled cooling air emerging from the tube bundle at the bottom is deflected once again and flows in the pressure vessel, on the outside, past the tube bundle upward, where it is extracted from the pressure vessel. Since, in these configurations of the air cooler, the inside of the outer wall of the pressure vessel is exposed solely to the already cooled cooling air, the outer wall can be designed at a comparatively low operating temperature, thus affording considerable advantages, for example, with regard to the wall thickness required. By contrast, there are the disadvantages that the overall air stream has to be deflected upward, that a large annular duct is required for the deflected overall air stream, and that the overhead outlet connection piece is not suitable for the turbine.

By contrast, in the embodiment of FIG. 5 of EP-A1-0 773 349, the second deflection of the cooling air to the outlet of the tube bundle is dispensed with, and the cooled air is extracted directly below the tube bundle from the pressure vessel which at the same time also forms the container for the tube bundle. This variant has various plant-related advantages, but has the disadvantage that the walls of the pressure vessel become too hot, because they are exposed, particularly in the upper region of the air cooler, directly to the uncooled air coming from the compressor.

SUMMARY OF THE INVENTION

The object of the invention, then, is to provide an air cooler for power plants, which avoids the disadvantages of the air cooler last mentioned, without relinquishing the plant-related advantages of the latter, and to specify a use of this air cooler.

The essence of the invention is to use a mixed configuration of the two known embodiments, in which the main part of the air flowing through the air cooler is extracted, unchanged, at the same end of the air cooler where it is also supplied (as in FIG. 5 of EP-A1-0 773 349), but to cause a small fraction of the cooled air, after the latter emerges from the tube bundle, to flow upward in a bypass circuit on the outside between the tube bundle and the outer wall of the pressure vessel and to take off said small fraction there (as in FIGS. 2 to 4 of EP-A1-0 773 349). In this way, the outer wall of the pressure vessel is sufficiently cooled, but the main extraction of the cooling air nevertheless takes place at the bottom of the (vertically standing) air cooler.

A preferred refinement of the air cooler according to the invention is distinguished in that the separate connection means comprise at least one outlet connection piece issuing to the third space from outside and also a connecting tube which connects the at least one outlet connection piece to the air outlet connection piece, and in that the connecting tube terminates within the air outlet connection piece in a diffuser. The outlet connection piece belonging to the bypass can project into the third space. A plurality of outlet connection pieces may also be provided, which are collected at a connecting tube.

An optimum effect arises for an air cooler of the invention when, according to another preferred refinement, the annular gap and the separate connection means are dimensioned such that the bypass air stream flowing through the annular gap amounts to about 10% of the overall air stream flowing through the air cooler.

Preferably, furthermore, a water inlet chamber connected to that side of the tube bundle which faces the second space is arranged individually in the region of the second space on the pressure vessel and a steam outlet chamber connected to that side of the tube bundle that faces the third space is arranged in the region of the third space.

Furthermore, it is expedient if the air cooler stands vertically, and if the second space is arranged at the bottom and the first and third spaces are arranged at the top.

BRIEF DESCRIPTION OF THE DRAWINGS

The invention will be explained in more detail below with reference to exemplary embodiments, in conjunction with the drawing in which.

DETAILED DESCRIPTION OF THE INVENTION

Figure 2:
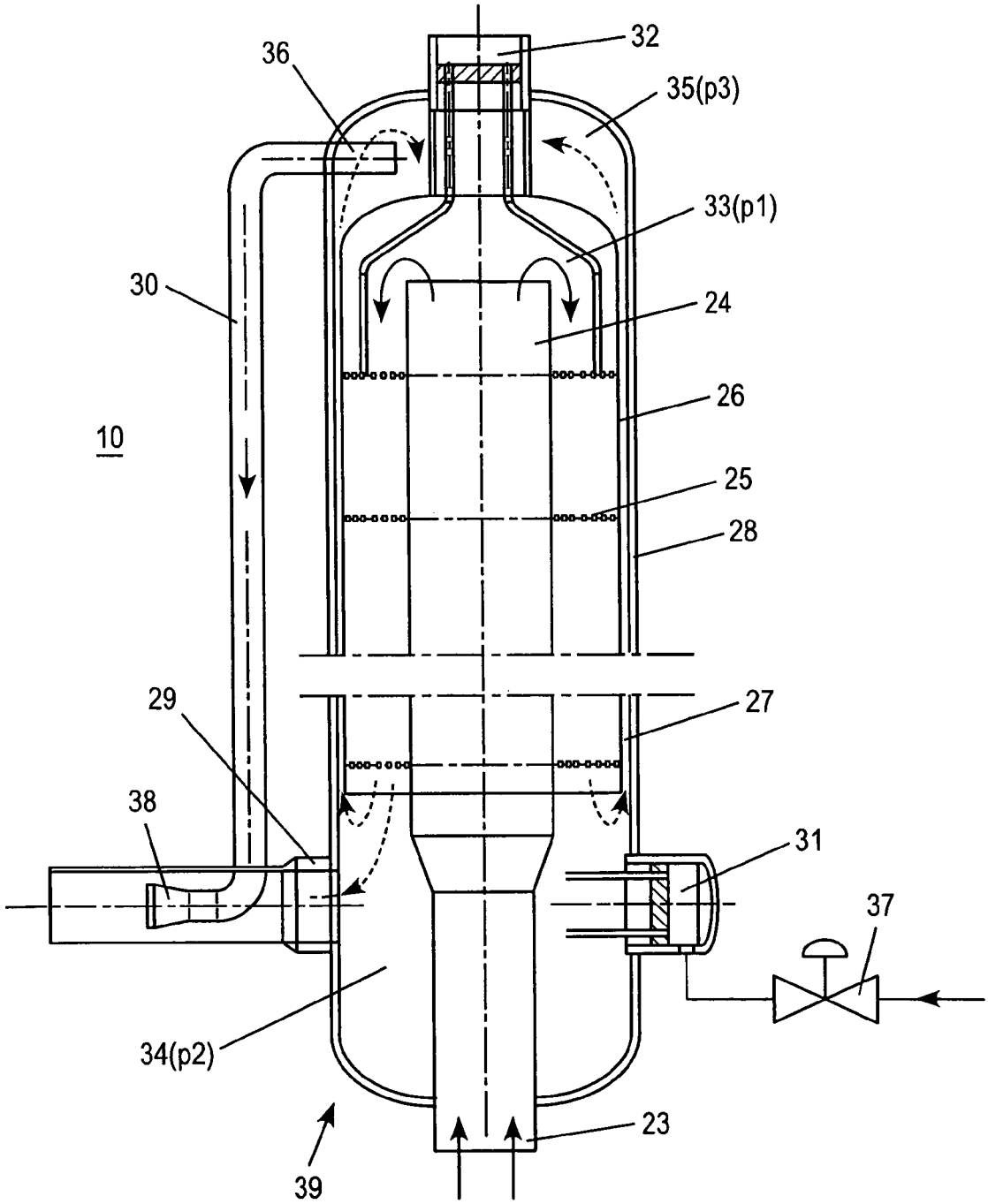
FIG. 2 shows a longitudinal section through an air cooler according to a preferred exemplary embodiment of the invention.

FIG. 2 illustrates, in longitudinal section, an air cooler according to a preferred exemplary embodiment of the invention. The air cooler 10 has an elongate, vertically standing, essentially cylindrical pressure vessel 39 which is closed off at the lower and the upper end in each case by means of a convexly curved bottom. Within the pressure vessel is accommodated an arrangement coaxial to the longitudinal axis of the air cooler 10 and consisting of a cylindrical central tube 24, and a helical tube bundle 25 surrounding the central tube 24 and of a cylindrical inner casing 26 surrounding the tube bundle 25. The central tube 24 issues, at the upper end of the coaxial arrangement 24, 25, 26, into a first space 33 adjacent to the tube bundle 25 and closed off outwardly by means of the inner casing 26. The central tube 24 is acted upon by air from outside the pressure vessel 39, via an air inlet connection piece 23, at the lower end of the coaxial arrangement 24, 25, 26 through a second space 34 adjacent to the tube bundle 25. The casing surrounding the tube bundle 25 and the first space 33 is designed as an inner casing 26 separate from the pressure vessel 39. The inner casing 26 is surrounded concentrically by the cylindrical outer casing 28 of the pressure vessel 39 so as to form an annular gap 27 between the inner casing 26 and the outer casing 28. Outside the first space 33 and inside the pressure vessel 39 is formed, at the upper end of the pressure vessel 39, a third space 35 which is connected to the second space 34 via the annular gap 27.

For the supply of water, the pressure vessel 39 has arranged on it, in the region of the lower second space 34, a water inlet chamber 31 which is connected to the lower end of the tube bundle 25 via supply lines (illustrated only in a rudimentary way in FIG. 2) and which receives water from outside via a regulating valve 37. For the extraction of steam generated in a tube bundle 25, there is arranged, in the region of the upper third space 35, a steam outlet chamber 32 which is connected to the upper end of the tube bundle 25 via supply lines and via which steam can be extracted from the tube bundle 25. The second space 34 is accessible from outside via an air outlet connection piece 29. The third space 35 is connected to this air outlet connection piece 29 in the manner of a bypass via a separate connecting tube 30 which is connected on the inlet side to an outlet connection piece 36 led out of the third space 35 and which terminates on the outlet side in a diffuser 38 arranged coaxially in the tubular air outlet connection piece 29.

Figure 1:
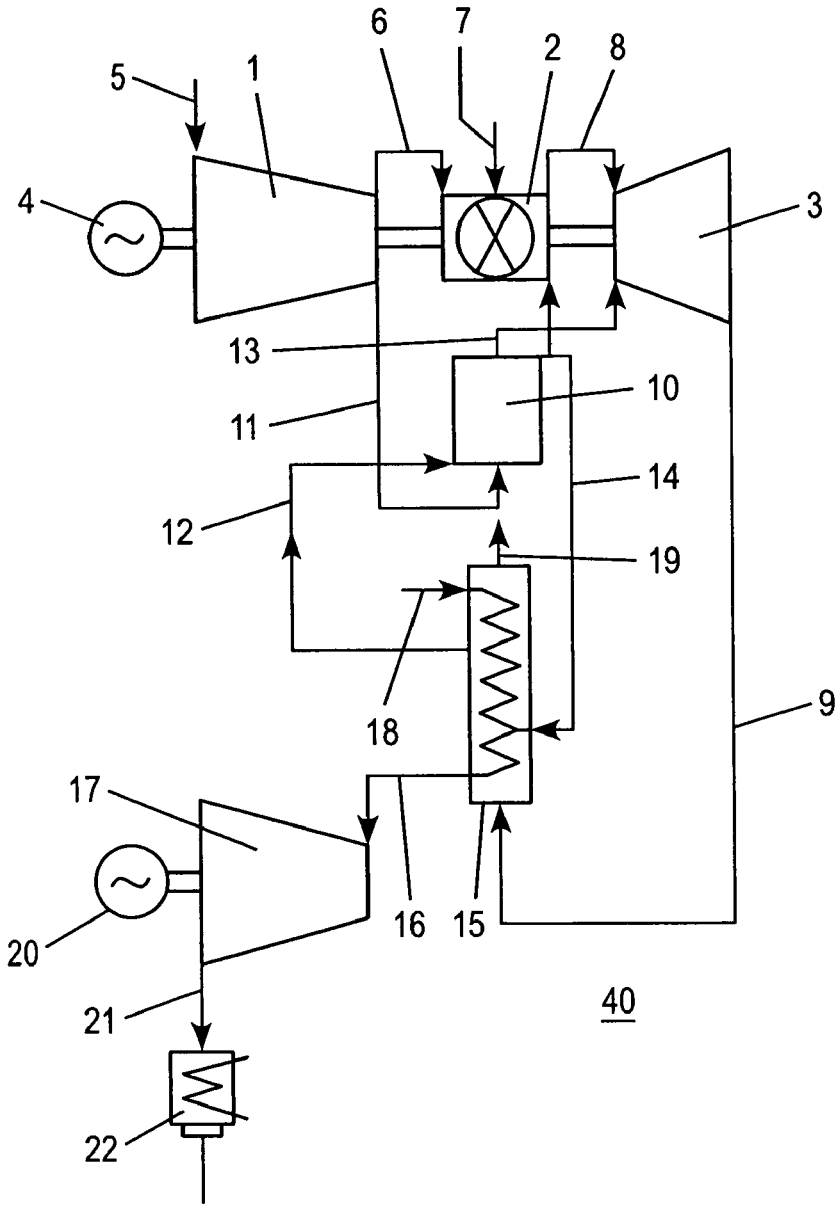
FIG. 1 shows a simplified plant diagram of a combined power plant with cooling-air cooler, such as is suitable for the use of the air cooler according to the invention.

When the air cooler 10 is in operation, air is conducted from below through the air inlet connection piece 23 into the central tube 24 (unbroken double arrow in FIG. 2) and emerges from the central tube 24, above the tube bundle 25, into the first space 33 at a pressure p1, is deflected according to the curved arrows depicted in FIG. 2 and flows downward through the tube bundle 25. The air, on its way through the tube bundle 25, discharges heat to the water flowing in countercurrent to the tube bundle 25 and emerges, cooled, from the lower end of the tube bundle 25 into the second space 34 at a pressure p2. Owing to the pressure losses in the tube bundle, the pressure p2 is lower than the pressure p1. The main part of the cooled air present in the second space emerges from the pressure vessel 39 through the air outlet connection piece 29 and is used further, for example, according to FIG. 1, for the cooling of specific plant parts.

A bypass stream of about 10% of the cooled air present in the second space 34 flows through the annular gap or the annular duct 27 between the inner casing 26 and the outer casing 28 upward into the third space 35 and at the same time cools the inner casing 26 and the outer casing 28. The annular gap 27 has, for example, a width of 20 mm. In the third space 35, a pressure p3 prevails, which, owing to the pressure losses in the annular gap 27, is lower than the pressure p2. The bypass-air flows out of the third space 35 via the outlet connection piece 36, the connecting tube 30 and the diffuser 38 into the air outlet connection piece 29 arranged at the bottom and is mixed there with the main air stream. The acceleration pressure drop in the air outlet connection piece 29 lowers the static pressure in the air outlet connection piece 29 to a value lower than p2. This driving pressure difference (suction action) is utilized in order to overcome the frictional and curvature pressure drop and to achieve a bypass air stream through the annular gap 27. The desired bypass air stream (for example, 10% of the overall air stream) can be set by the dimensioning of the annular gap 27, connecting tubes 30 and tube end geometry (diffuser 38) of the connecting tube 30. Since the air flowing through the annular gap 27 cools the outer casing 28 of the pressure vessel 39, the wall thickness of the outer casing 28 or of the pressure shell can be designed for the lower air temperature.

The air cooler according to the invention is distinguished, overall, by the following advantages and characteristic properties:

- The design temperature of the outer casing 28 and the convexly curved bottoms can be reduced. This affords savings in terms of material.
- The installation of a simpler steam collector construction becomes possible; this avoids individual tubes having to be led through the outer shell.
- The diameter of the outer casing 28 is reduced, for example by 150 mm, as compared with the air cooler with air outlet at the upper end (FIGS. 2 to 4 of EP-A1-0 773 349). This is accompanied by a small wall thickness of the outer casing 28.
- The reheating of the cooled air stream is lower, as compared with the known casing cooling by the overall air stream (for example 5 K instead of 7 K).
- The overall pressure loss, with the tube bundle 25 and the air outlet connection piece 29 remaining the same, is lower, as compared with the known casing cooling by the overall air stream.

LIST OF REFERENCE SYMBOLS

1 Compressor
2 Combustion chamber
3 Gas turbine
4, 20 Generator
5 Intake air
6, 11 Compressed air
7 Fuel
8 Hot gas
9 Exhaust gas
10 Air cooler
12 Part stream (water)
13 Cooling air
14 Steam (from the air cooler)
15 Heat recovery steam generator (HRSG)
16 Fresh steam
17 Steam turbine
18 Feed water
19 Flue gas
21 Exhaust steam
22 Condenser
23 Air inlet connection piece
24 Central tube
25 Tube bundle (helix)
26 Inner casing
27 Annular gap (annular duct)
28 Outer casing (pressure vessel)
29 Air outlet connection piece
30 Connecting tube (bypass)
31 Water inlet chamber
32 Steam outlet chamber
33, 34, 35 Space
36 Outlet connection piece (bypass)
37 Regulating valve
38 Diffuser
39 Pressure vessel
40 Power plant (combined plant)

The invention claimed is:

1. An air cooler for power plants, comprising:

a pressure vessel, in which is accommodated a coaxial arrangement containing a cylindrical central tube, a helical tube bundle surrounding the central tube and a cylindrical casing surrounding the tube bundle, the central tube extends, at one end of the coaxial arrangement, into a first space adjacent to the tube bundle and closed off outwardly by the casing, the central tube being positioned to be acted upon by air from outside the pressure vessel, via an air inlet connection piece, at the other end of the coaxial arrangement through a second space adjacent to the tube bundle;

connection means for the tube bundle being provided, by which water can be fed into the tube bundle from the other end of the coaxial arrangement and steam can be extracted from the tube bundle at the one end, and the second space being accessible from outside via an air outlet connection piece and;

the casing surrounding the tube bundle and the first space, designed as an inner casing separate from the pressure vessel, the inner casing being surrounded concentrically by a cylindrical outer casing of the pressure vessel so as to form an annular gap between the inner casing and the outer casing, wherein outside the first space and inside the pressure vessel, a third space is formed, which is connected to the second space via the annular gap, the third space being connected to the air outlet connection piece via separate connection means such that, during operation, a pressure is established in the third space which is lower than the pressure in the second space.

2. The air cooler as claimed in claim 1, wherein the separate connection means comprise at least one outlet connection piece issuing into the third space from outside, and a connecting tube which connects the at least one outlet connection piece to the air outlet connection piece.

3. The air cooler as claimed in claim 2, wherein the connecting tube terminates within the air outlet connection piece in a diffuser.

4. The air cooler as claimed in claim 1, wherein the annular gap and the separate connection means are dimensioned such that the bypass air stream flowing through the annular gap amounts to about 10% of the overall air stream flowing through the air cooler.

5. The air cooler as claimed in claim 1, wherein a water inlet chamber connected to that side of the tube bundle which faces the second space is arranged in the region of the second space on the pressure vessel, and a steam outlet chamber connected to that side of the tube bundle which faces the third space is arranged in the region of the third space.

6. The air cooler as claimed in claim 1, wherein the air cooler stands vertically, and the second space is arranged at the bottom and the first and the third space are arranged at the top.

7. A use of the air cooler as claimed in claim 1, for cooling the cooling air, extracted from a compressor, in a combined power plant, the water being extracted from a heat recovery steam generator in order to be fed into the tube bundle, and the steam generated in the tube bundle being fed into the heat recovery steam generator.

* * * * *